United States Patent [19]

Cheng

[11] Patent Number: 4,894,025

[45] Date of Patent: Jan. 16, 1990

[54] PLUG

[76] Inventor: Yu Feng Cheng, No. 7, Fu Hsing St., Tu Cheng Ind. Dist., Taipei, Taiwan

[21] Appl. No.: 348,384

[22] Filed: May 8, 1989

[51] Int. Cl.[4] ..... H01R 17/04

[52] U.S. Cl. ..... 439/578

[58] Field of Search ..... 439/578–585, 439/675, 752, 869, 879

[56] References Cited

U.S. PATENT DOCUMENTS

| | | | |
|---|---|---|---|
| 3,452,323 | 6/1969 | Bowley et al. | 439/578 |
| 3,600,531 | 8/1971 | Hoegerl | 439/675 |
| 3,978,581 | 9/1976 | Miura | 439/675 |

*Primary Examiner*—Joseph H. McGlynn
*Attorney, Agent, or Firm*—Keaty & Keaty

[57] ABSTRACT

A plug including a prong, a cylindrical insulating member, a clamping sleeve, a cord and a plastic sleeve. The cylindrical insulating member has a lengthwise oriented central circular slot for receiving the prong, a vertically oriented rectangular slot, a slit, two recesses on lateral sides, and two fixing plates. The clamping sleeve has a notch, two cutouts adjacent the notch, and two engaging bodies adjacent to the two cutouts respectively. The two engaging bodies are engageable in the two recesses and the clamping sleeve has an extension piece which is formed with a circular hole and a rectangular hole. The end of the extension piece is further extended to define two clamping plates. The cord has a conducting wire and a copper wire. The conducting wire is connectable to the prong by using a pair of electric poles. The plastic sleeve is provided to enclose the clamping sleeve.

1 Claim, 4 Drawing Sheets

PLUG

BACKGROUND OF THE INVENTION

The present invention relates to a plug adapted to be connected with the main body of electrical appliance, and more particularly, to such a plug having a rigid structure and being easy to manufacture.

Conventional plugs, as shown in FIG. 7, include a prong 1*a* which is insertable into an insulating member 2*a* covered by a clamping sleeve 3*a*. The prong 1*a* has a projecting plate at its rear part. The clamping sleeve 3*a* also has a projecting plate at its rear part. A copper wire 1*b* is soldered onto the projecting plate of the prong 1*a* by solder flux 1*c*. A copper wire 3*b* is soldered onto the projecting plate of the clamping sleeve 3*a* by solder flux 3*c*. It should be noted that at least one of the copper wires 1*b*, 3*b*, must be encased with an insulating layer. However, in order to solder the two copper wires 1*b* and 3*b*, the insulating layer of the copper wire 1*b* or 3*b* must be peeled prior to soldering such that the copper part of the wire 1*b* or 3*b* is exposed to the exterior. Obviously, the step of peeling the insulating layer complicates the manufacturing of the plug.

Furthermore, due to the connection of the copper wires 1*b*, 3*b* both by soldering, the resistance between the copper wires 1*b*, 3*b* and the prong 1a and also the clamping sleeve 3*a* becomes larger. The result of such larger resistance is poor conductivity.

In addition, each solder flux, 1*c* or 3*c*, may be torn off of the connection part, thereby increasing the danger of a short circuit.

SUMMARY OF THE INVENTION

It is therefore a primary object of the present invention to provide a plug adapted to be connected with the main body of an electrical appliance.

A further object of the present invention is to provide a plug having a rigid structure and which is easy to manufacture.

Another object of the present invention is to provide a plug, in which the conducting wire thereof can be connected to its prong without peeling the insulating layer thereof.

Still another object of the present invention is to provide a plug having a structure in which one of its wires is capable of being connected to the prong thereof through the use of electric poles instead of flux soldering.

Further objects and advantages of the present invention will be apparent to those skilled in the art upon reading the specification provided hereinbelow, with particular reference to the drawings.

DETAILED DESCRIPTION OF PREFERRED EMBODIMENT

Figure 1:
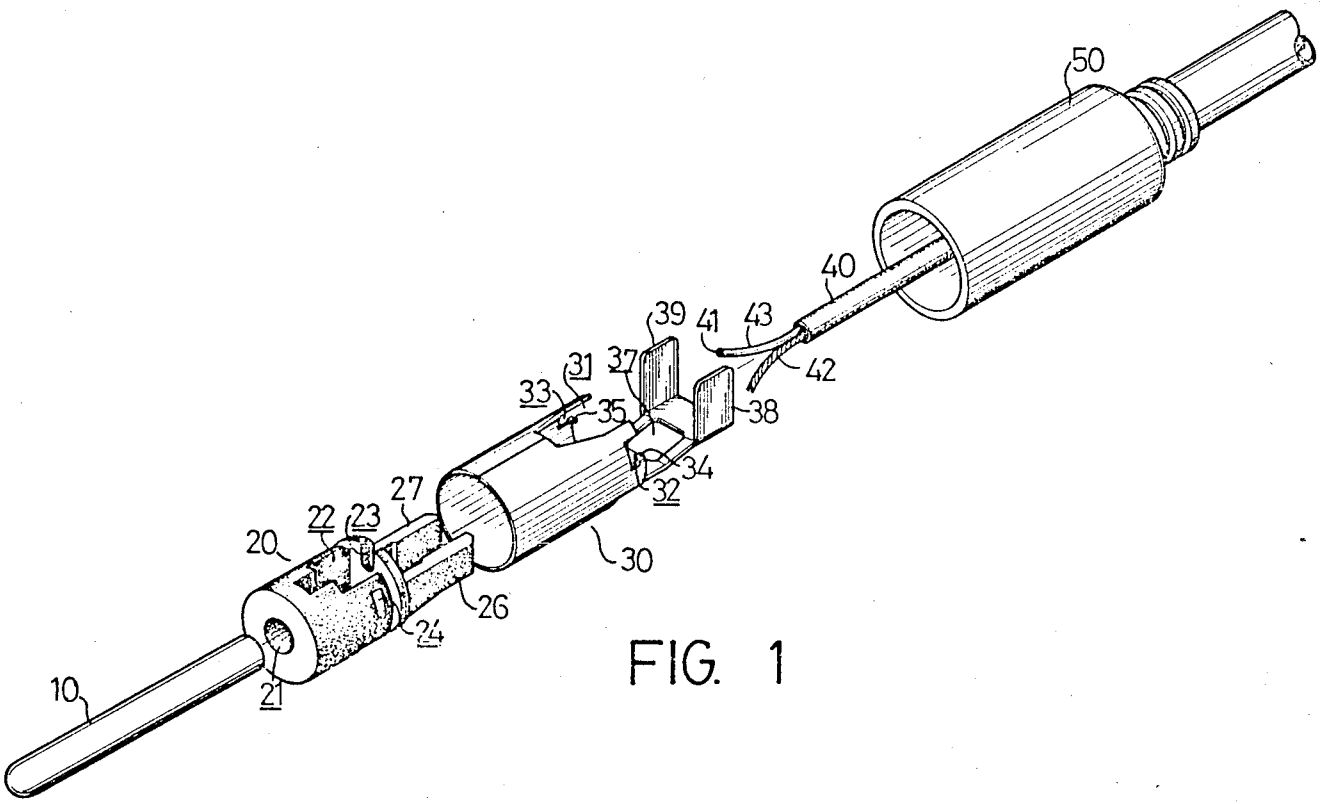
FIG. 1 is an exploded view of a plug in accordance
Figure 2:
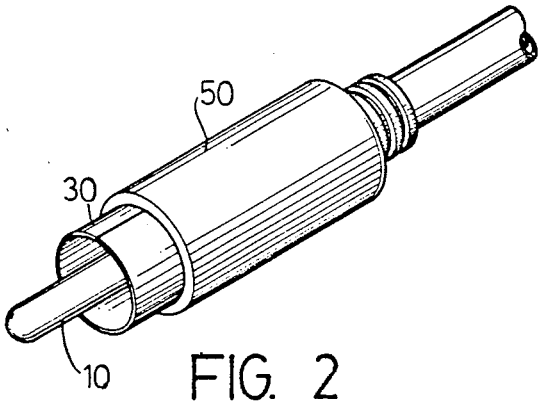
FIG. 2 is a perspective view showing an assembled plug of FIG. 1.

Referring to FIGS. 1 and 2, a plug constructed in accordance with the present invention comprises a prong 10, an insulating member 20, a clamping sleeve 30, a cord 40 and a plastic sleeve 50.

The prong 10, in general, is substantially rod-shaped. The end part of the prong 10 is conical in shape for insertion into the socket of an electrical appliance.

The insulating member 20 is substantially cylindrical in shape and includes a lengthwise oriented central circular slot 21 for receiving the prong 10, a vertically oriented rectangular slot 22, a slit 23 for the entry of the cord 40, two recesses 24 and 25 on the lateral sides thereof respectively for engagement purposes, and two fixing plates 26 and 27 protruded lengthwise from the end face remote from the slot 21.

the clamping sleeve 30 includes a notch 31, two cutouts 32, 33 besides the notch 31, two engaging bodies 34, 35 adjacent to two respective cutouts 32 and 33. The two engaging bodies 34 and 35 are engageable in the two recesses 24 and 25 of the insulating member 20, respectively. the clamping sleeve 30 further includes an extension piece which is formed with a circular hole 36 (see FIG. 5) and a rectangular hole 37. The end of the extension piece is further extended to define two clamping plates 38 and 39.

The cord 40 comprises a conducting wire 41 and a copper wire 42 therein. The conducting wire 41 is encased with an insulating layer 43.

The plastic sleeve 50 encloses the clamping sleeve 30 such that the plug can be held in one's hand.

Figure 3:
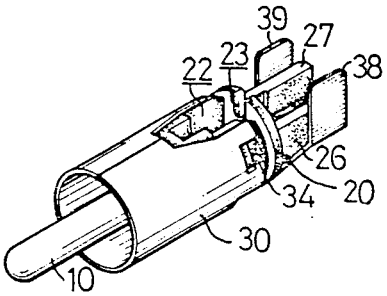
FIG. 3 is a perspective view showing a partially assembled plug of FIG. 1.
Figure 4:
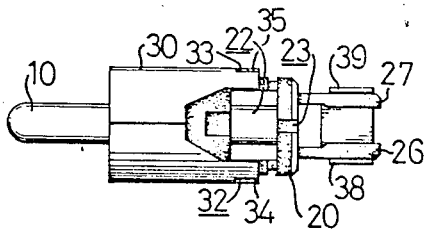
FIG. 4 is a top view showing a partially assembled plug of FIG. 1.
Figure 5:
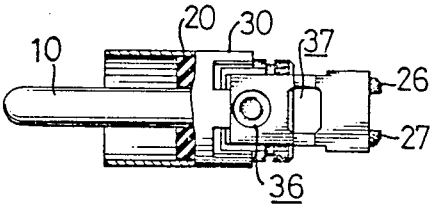
FIG. 5 is a bottom view showing a partially assembled plug of FIG. 1.

With particular reference to FIGS. 3, 4 and 5, various steps of the assembly of the plug can be understood. The prong 10 is inserted into the circular slot 21 of the insulating member 20. The insulating member 20 is enclosed by the clamping sleeve 30, wherein the engaging bodies 34, 35 are received in respective recesses 34, 35, and wherein the fixing plates 26, 27 of the insulating member 20 are clamped by the clamping plates 38, 39 of the clamping sleeve 30. The conducting wire 41 is placed within the slit 23 of the insulating member 20.

Figure 6:
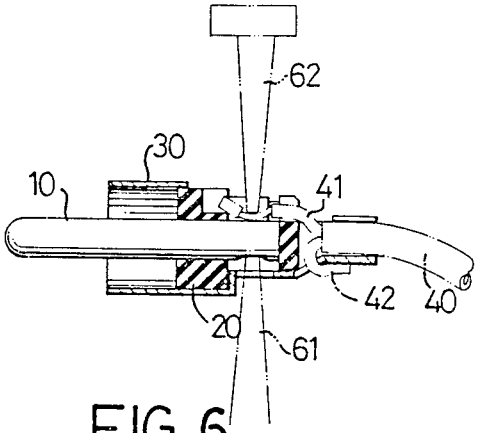
FIG. 6 is a schematic view showing the contact of an upper electric pole and a lower electrical pole with a prong and a conducting wire of the plug of FIG. 1.
Figure 7:
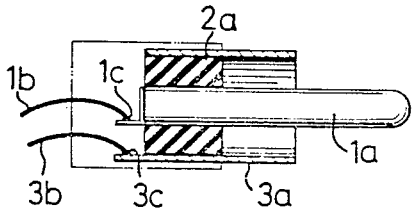
FIG. 7 PRIOR ART
FIG. 7 is a sectional view of a conventional plug.

Referring next to FIG. 6, the plug is properly adjusted such that the circular hole 36 is in alignment with a lower electric pole 61 so that the lower electric pole 61 has access to the prong 10. An upper electric pole 62, which is electrified, is pressed against the prong 10, through the notch 33 and the rectangular slot 22, such that the conducting wire 41 is pressed against the prong 10. At this juncture, discharging takes place between the upper electric pole 62 and the lower electric pole 61. The temperature could be up to 220° C. The insulating layer 43 of the conducting wire 41, at this temperature, melts such that the copper part inside the conducting wire 41 contacts with an upper side of the prong 10. The copper wire 42 is soldered to the lower edge of the clamping sleeve 30. Finally, the plastic sleeve 50 is employed to enclose the entire plug body.

While the present invention has been described with respect to a preferred embodiment of the invention, it will be understood by those skilled in the art after understanding the invention, that changes and modifications may be made without departing from the spirit and the scope of the invention defined by the following claims.

I claim:

1. A plug comprising:

a substantially rod-shaped prong (10) having a conical end part;

a cylindrical insulating member (20) including a lengthwise oriented central circular slot (21) for receiving said prong (10), a vertically oriented rectangular slot (22), a slit (23), two recesses (24) and (25) on lateral sides thereof respectively, and two fixing plates (26), (27) lengthwise protruded from an end face remote from said slot (21);

a clamping sleeve (30) including a notch (31), two cutouts (32), (33) besides said notch (31), two engaging bodies (34), (35) adjacent to said two cutouts (32) and (33) respectively, said two engaging bodies (34) and (35) being engageable in the two recesses (24) and (25) respectively, said clamping sleeve (30) further including an extension piece which is formed with a circular hole (36) and a rectangular hole (37), and end of said extension piece being further extended to define two clamping plates (38), (39);

a cord (40) including a conducting wire (41) and a copper wire (42) therein, said conducting wire (41) being encased with an insulating layer (43); and a plastic sleeve (50) enclosing said clamping sleeve (30);

whereby said conducting wire (41) is connectable to said prong (10) by using a lower electric pole (61) and an upper electric pole (62); said plug is adjusted such that said circular hole (36) of said clamping sleeve (30) is in alignment with said lower electric pole (61) so that said lower electric pole (61) is in contact with said prong (10), said upper electric pole (62), which is electrified, is pressable against said prong (10), through said notch (33) and said rectangular slot (22), so as to press said conducting wire (41) against said prong (10), whereby discharging between said upper electric pole (62) and said lower electric pole (61) causes said insulating layer (43) of said conducting wire (41) to melt such that a copper part inside said conducting wire (41) contacts with an upper side of said prong (10).

* * * * *